US006623056B1

(12) United States Patent
Wickson

(10) Patent No.: US 6,623,056 B1
(45) Date of Patent: Sep. 23, 2003

(54) BAG HOLDER

(76) Inventor: Arthur L. Wickson, 200 E. Fillmore #223, Phoenix, AZ (US) 85004

( * ) Notice: Subject to any disclaimer, the term of this patent is extended or adjusted under 35 U.S.C. 154(b) by 0 days.

(21) Appl. No.: 10/175,772

(22) Filed: Jun. 20, 2002

Related U.S. Application Data

(60) Provisional application No. 60/303,747, filed on Jul. 6, 2001.

(51) Int. Cl.[7] ..... B65D 33/06

(52) U.S. Cl. ..... 294/158; 294/137; 294/142; 383/13

(58) Field of Search ..... 294/137, 142, 294/158, 159, 170, 171; 16/406, 422, 425; 383/6, 13, 25, 26

(56) References Cited

U.S. PATENT DOCUMENTS

D352,902 S * 11/1994 Halverson ..... D9/455
D359,235 S * 6/1995 Kennedy et al. ..... D9/434
5,697,661 A * 12/1997 Robinson et al. ..... 294/142
5,904,388 A * 5/1999 Seibel ..... 294/163
6,347,822 B1 * 2/2002 Miller, Jr. ..... 294/158

FOREIGN PATENT DOCUMENTS

BE 505660 * 1/1953 ..... 294/137
FR 2632-933 * 12/1989 ..... 294/137
FR 2652-563 * 4/1991 ..... 294/137

* cited by examiner

*Primary Examiner*—Dean J. Kramer
(74) *Attorney, Agent, or Firm*—Parsons & Goltry; Michael W. Goltry; Robert A. Parsons

(57) ABSTRACT

A bag holder includes a handle having ends and a bag catch having ends. The ends of the bag catch are attached to the ends of the handle. The handle and the catch define an opening of the bag holder, and the handle is severed between its ends defining opposing free ends and an end gap therebetween.

12 Claims, 2 Drawing Sheets

BAG HOLDER

CROSS-REFERENCE TO RELATED APPLICATION

This application claims the benefit of U.S. Provisional Application Ser. No. 60/303,747, filed Jul. 6, 2001.

FIELD OF THE INVENTION

This invention relates to apparatus and methods for holding and transporting handled objects.

BACKGROUND OF THE INVENTION

Carrying multiple handled objects such as bags is difficult, especially for the elderly and those having weak or injured hands. One of the most common situations in which people usually carry multiple bags by hand is when shopping for groceries, where it is common to see people carrying multiple plastic grocery bags by hand to and from their vehicles. Although carrying multiple grocery bags is a persistent problem for many, the art is want of a simple and inexpensive device that is capable of aiding people in comfortably and safely carrying multiple grocery bags. Given this deficiency in the art, the need for certain new and useful improvements is evident.

SUMMARY OF THE INVENTION

The above problems and others are at least partially solved and the above purposes and others realized in a new and improved bag holding that includes a handle having ends and a bag catch having ends. The ends of the bag catch are attached to the ends of the handle. The handle and the catch define an opening of the bag holder, and the handle is severed between its ends defining opposing free ends and an end gap therebetween. The handle has an outer edge and an opposing inner edge facing the opening. The end gap severs the outer and inner edges of the handle. The catch is inwardly flexed maintaining the free ends of the handle in an engaged or abutting state. Preferably, a first recess is disposed at one of the free ends of the handle between the outer and inner edges of the handle, and an opposing second recess is disposed at the other of the free ends of the handle between the outer and inner edges of the handle. A support is capable of being disposed between the free ends of the handle and secured by and between the opposing first and second recesses. In another embodiment, the invention incorporates a support disposed between the free ends of the handle and secured by and between the first and second recesses. An outwardly facing first beveled edge is carried by one of the free ends of the handle at the outer edge of the handle, and an opposing outwardly facing second beveled edge is carried by the other of the free ends of the handle at the outer edge of the handle. The second beveled edge is the mirror image of the first beveled edge.

BRIEF DESCRIPTION OF THE DRAWINGS

Referring to the drawings.

DETAILED DESCRIPTION OF A PREFERRED EMBODIMENT

Figure 1:
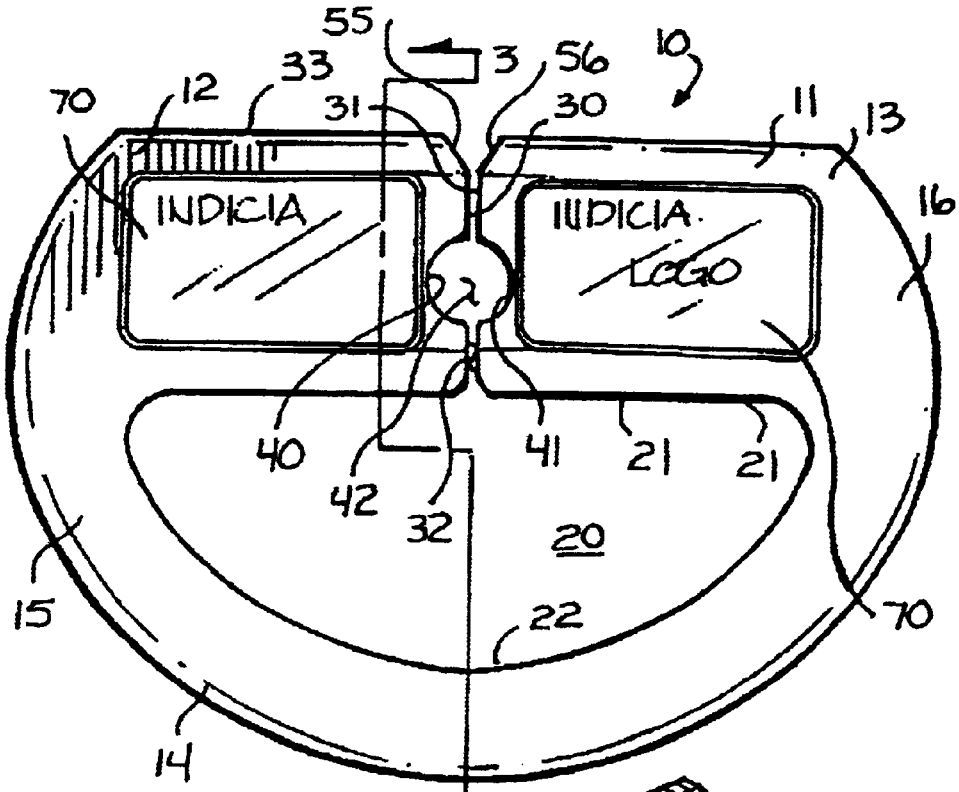
FIG. 1 is a side elevation of a bag holder constructed in accordance with the teachings of the invention, the bag holding including a catch and an attached handle, which is severed defining free ends and an end gap therebetween.

Turning now to the drawings, in which like reference characters indicate corresponding elements throughout the several views, attention is first directed to FIG. 1 in which is seen a bag holder, embodying the principle of the instant invention, generally indicated by the reference character 10 including a handle 11 having ends 12,13 and a bag catch 14 having ends 15,16. Ends 15,16 of catch 14 are attached to ends 12,13, respectively, of handle 11. Handle 11 and catch 14 make up a semi-circular body, and catch 14 opposes and underlies handle 11. Catch 14 is considered the lower member of bag holder 10, and handle 11 is considered the upper member of bag holder 10. Inner edges 21,22 of handle 11 and catch 14, respectively, define an opening 20 of bag holder 10. Handle 11 is severed between ends 12,13 defining opposing free ends 30,31 of handle 11 and an end gap 32 or channel therebetween. Handle 11 has an outer edge 33 opposing its inner edge 21, which faces and partially defines opening 20. End gap 32 severs outer and inner edges 33,21 of handle 11.

In one embodiment, catch 14 is inwardly flexed maintaining free ends 30,31 of handle 11 in an engaged or abutting state. In another embodiment of the invention, the inwardly flexed nature of catch 14 is provided to maintain free ends 30,31 in close proximity to one another or otherwise in a confronting state, rather than engaged to one another. Preferably, a recess 40 is formed into and disposed at free end 30 of handle 11 between outer and inner edges 33,21, and an opposing recess 41 is formed into and disposed at free end 31 handle 11 between outer and inner edges 33,21. Recess 41 is the mirror image of recess 40. Recesses 40,41 together define an engagement opening 42 of bag holder 10.

Bag holder 10 is formed of a flexibly rigid material or combination of materials, whether plastic, a selected metal, a selected metal composite, etc., and although is preferably integrally formed such as through molding or machining can be formed as an assembly of two or more attached parts, if desired. Welding, adhesive, screws, rivets or other suitable fastening structure can be used for attaching together the various parts of bag holder 10 if so constructed. The flexibly rigid character of bag holder 10 permits free ends 30,31 to be moved apart in response to a forcible impulse applied to bag holder 10, such as at handle 11. By releasing such a forcible impulse, bag holder 10 will resume its original shape, and the material or materials used in the construction of bag holder 10 permit it to carry out this function.

Figure 2:
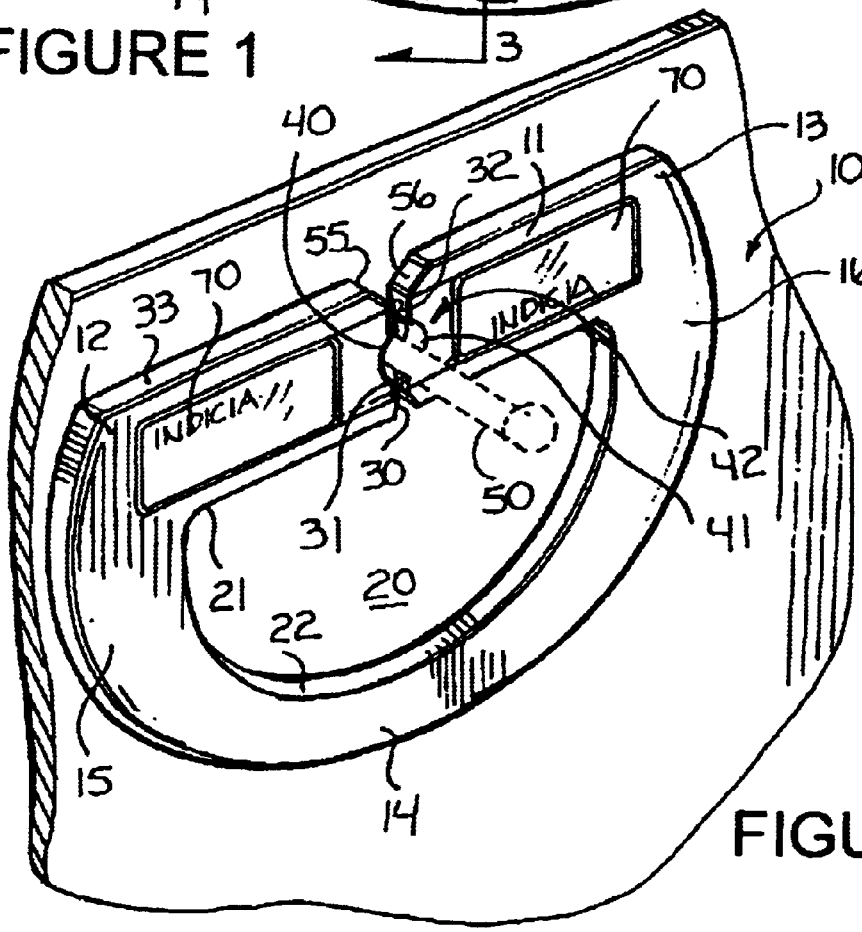
FIG. 2 is a perspective view of the bag holder of FIG. 1.

A support, such as an elongate rod, is capable of being disposed between free ends 30,31 of the handle and secured by and between recesses 40,41. In another embodiment, the invention incorporates a support, which is denoted in FIG. 2 at 50. In this embodiment, support 50 is an elongate rod supported by and extending from wall or shelving structure. As illustrated, support 50 is disposed between free ends 30,31 of handle 11 and secured by and between recesses 40,41, which arrangement causes bag holder 10 to be maintained and supported by support 50. To engage bag holder 10 to support 50, a free end of support 50 can be forcibly inserted through support opening 42. Forcibly drawing bag holder 10 away from support 50 disengages bag holder 10 from support 50. Another way to engage bag holder 10 with support is to apply a forcible impulse to bag holder 10, such as at handle 11, spreading free ends 30,31 apart, positioning support 50 between free ends 30,31 disposing recesses 40,41 on either side of support 50 and then releasing the forcible impulse against bag holder 10 to cause ends 30,31 to come together disposing support 50 at support opening 42 and causing recesses 40,41 to engage and secure support 50. Removal of bag holder 10 from support 50 can be accomplished by reversing this procedure. It will be appreciated that many such bag holders can be secured to support 50 for storage purposes, in which removal of each of the bag holders is easily accomplished as herein explained.

With continuing reference to FIG. 1, free end 30 is formed with an outwardly facing beveled edge 55, which is disposed at outer edge 33 of handle 11, and free end 31 is formed with an outwardly facing beveled 56, which is also disposed at outer edge 33 of handle 11. Beveled edge 56 is the mirror image of beveled edge 55, and beveled edges 55,56 cooperate and form a pocket of funnel at and leading into end gap 32.

Figure 3:
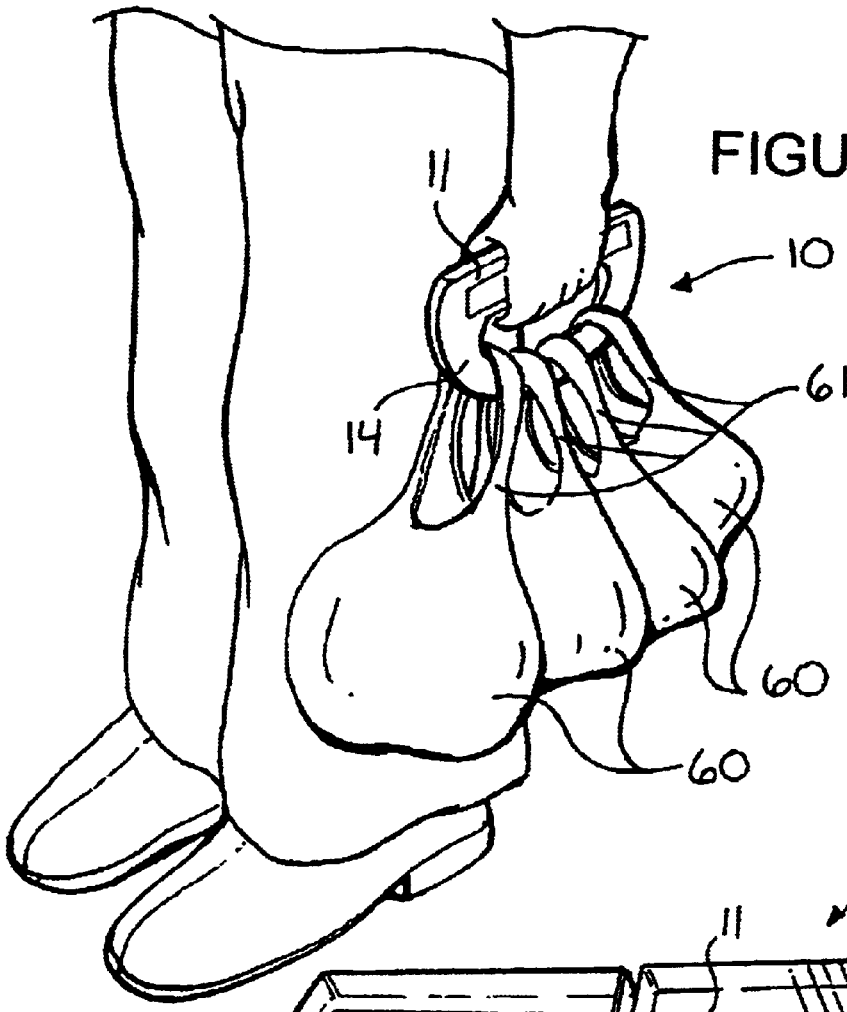
FIG. 3 illustrates the bag holder of FIG. 1 shown as it would appear in use securing handles of bags for transport.

Bag holder 10 has many uses. For example, end gap 32 can be used to pass therethrough the handles 61 of various and numerous types of bags 60 as shown in FIG. 3, which handles 61 then rest against and are secured by catch 14 or the lower member of bag holder 10. Bags 60 are representative of plastic grocery bags, which are ubiquitous in modern society. A person can then take up handle 11 by hand and carry multiple bags at one time. The pocket formed by beveled edges 55,56 serves to guide the handles of bags 60 into end gap 32. Bags 60 can be removed by passing the handles thereof through end gap 32, removing bags 60 from bag holder 10. Other uses not limited to carrying bags will readily occur to those skilled in the art. Finger gripping recesses can be included at inner edge 21 of handle 11 for increased comfort and gripping ability, if desired. An embodiment of the invention constitutes bag holder 10 and bags 60 having handles 61, in which handles 61 of bags 60 are secured by catch 14. So secured by catch 14, a further advantage of the invention is that bags so held by bag holder 10 help prevent items contained within the bags from falling out, such in a car during transport home from the grocery store, etc.

Turning back to FIGS. 1 and 2, indicia 70 are imparted to handle 11. Indicia 70 can be applied in any number of ways, such as by printing or etching. Indicia 70 can be adhesively attached or attached by means of lamination. Indicia 70 can also be embedded into handle 11, in which handle 11 would, of course, need to be transparent or at least partially transparent to allow indicia 70 to be visually perceived. Indicia 70 can be imparted to an inserts disposed in slots formed into handle 70. Those of ordinary skill will appreciate that indicia 70 can be applied in many ways. Indicia 70 are advertising or sensible indicia such as logo type indicia, logo wording, etc., for the purpose of conveying an advertising or other message or impression. Although indicia 70 are-disposed at handle 11 as illustrate, indicia can be imparted to bag holder 10 at other locations.

Figure 4:
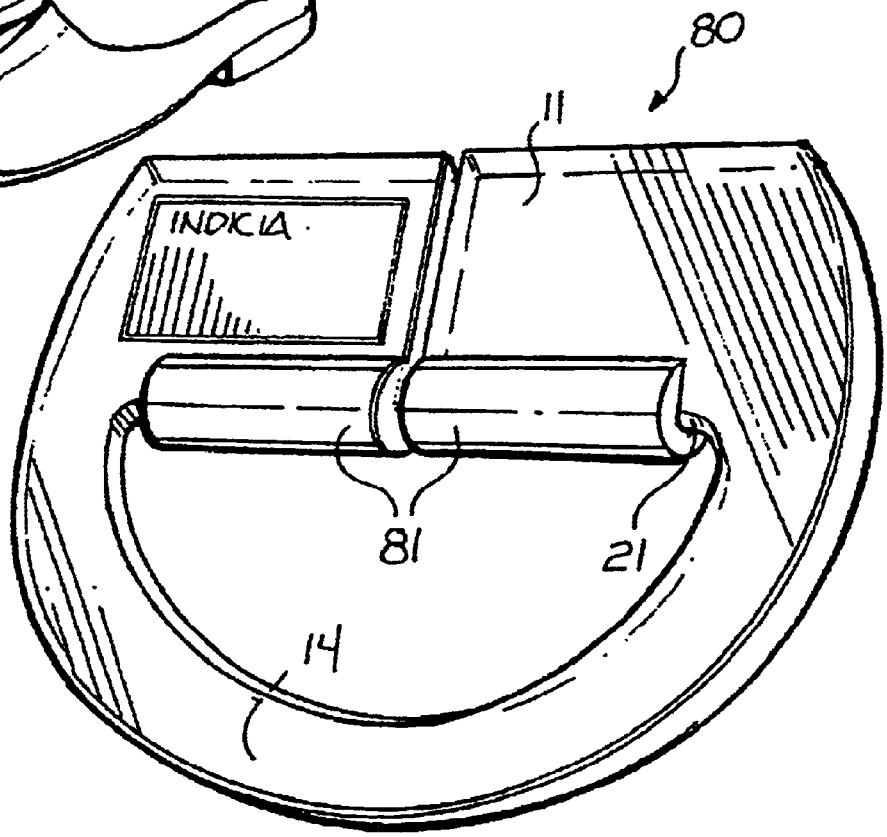
FIG. 4 is a perspective view of another embodiment of a bag holder constructed in accordance with the teachings of the invention.

Reference is now made to FIG. 4, in which there is seen an alternate embodiment of a bag holder generally designated by the reference character 80. In common with the previously described embodiment 10, the immediate embodiment designated 80 shares handle 11 and catch 14 and the various structure components thereof, and differs only in the enlarged or cylindrical gripping portion 81 disposed at inner edge 21 of handle 11 providing enhanced hand-gripping comfort. The operation of bag holder 80 is identical to bag holder 10. Finger gripping recesses can be included at gripping portion 18 for increased comfort and gripping ability, if desired.

The present invention is described above with reference to preferred embodiments. However, those skilled in the art will recognize that changes and modifications may be made in the described embodiments without departing from the nature and scope of the present invention. Various changes and modifications to the embodiments herein chosen for purposes of illustration will readily occur to those skilled in the art. To the extent that such modifications and variations do not depart from the spirit of the invention, they are intended to be included within the scope thereof.

Having fully described the invention in such clear and concise terms as to enable those skilled in the art to understand and practice the same, the invention claimed is:

1. Apparatus comprising:

a handle having ends;

a catch having ends;

the ends of the catch attached to the ends of the handle;

an opening defined by the handle and the catch;

the handle severed between the ends defining opposing free ends and an end gap therebetween;

a first recess disposed at one of the free ends of the handle; and an opposing second recess disposed at the other of the free ends of the handle.

2. Apparatus of claim 1, wherein the catch is inwardly flexed maintaining the free ends of the handle in an engaged state.

3. Apparatus of claim 1, further comprising:

the handle having an outer edge and an opposing inner edge facing the opening;

the end gap severing the outer and inner edges of the handle;

an outwardly facing first beveled edge carried by one of the free ends of the handle at the outer edge of the handle; and an opposing outwardly facing second beveled edge carried by the other of the free ends of the handle at the outer edge of the handle;

wherein the second beveled edge is the mirror image of the first beveled edge.

4. Bags having handles secured by the catch of the apparatus of claim 1.

5. Assembly comprising:

an apparatus comprising:

a handle having ends;

a catch having ends;

the ends of the catch attached to the ends of the handle;

an opening defined by the handle and the catch;

the handle severed between the ends defining opposing free ends and an end gap therebetween;

a first recess disposed at one of the free ends of the handle;

an opposing second recess disposed at the other of the free ends of the handle; and a support element disposed between the free ends of the handle secured by and between the first and second recesses.

6. Assembly of claim 5, wherein the catch is inwardly flexed maintaining the free ends of the handle in an engaged state.

7. Assembly of claim 5, further comprising:

the handle having an outer edge and an opposing inner edge facing the opening;

the end gap severing the outer and inner edges of the handle;

an outwardly facing first beveled edge carried by one of the free ends of the handle at the outer edge of the handle; and an opposing outwardly facing second beveled edge carried by the other of the free ends of the handle at the outer edge of the handle;

wherein the second beveled edge is the mirror image of the first beveled edge.

8. Assembly of claim 5, further comprising:

bags having handles; and the handles of the bags secured by the catch.

9. Assembly comprising:

an apparatus comprising:

a handle having ends, an outer edge and an opposing inner edge;

a catch having ends;

the ends of the catch attached to the ends of the handle;

an opening defined by the handle and the catch;

the handle severed defining opposing free ends and an end gap therebetween;

the end gap severing the outer and inner edges of the handle;

a first recess disposed at one of the free ends of the handle between the outer and inner edges of the handle;

an opposing second recess disposed at the other of the free ends of the handle between the outer and inner edges of the handle; and a support element disposed between the free ends of the handle secured by and between the first and second recesses.

10. Assembly of claim 9, wherein the catch is inwardly flexed maintaining the free ends of the handle in an engaged state.

11. Assembly of claim 9, further comprising:

an outwardly facing first beveled edge carried by one of the free ends of the handle at the outer edge of the handle; and an opposing outwardly facing second beveled edge carried by the other of the free ends of the handle at the outer edge of the handle;

wherein the second beveled edge is the mirror image of the first beveled edge.

12. Assembly of claim 9, further comprising:

bags having handles; and the handles of the bags secured by the catch.

* * * * *